US008289222B2

(12) United States Patent
Suetsuna et al.

(10) Patent No.: US 8,289,222 B2
(45) Date of Patent: Oct. 16, 2012

(54) CORE-SHELL MAGNETIC MATERIAL, METHOD OF MANUFACTURING CORE-SHELL MAGNETIC MATERIAL, DEVICE, ANTENNA DEVICE, AND PORTABLE DEVICE

(75) Inventors: Tomohiro Suetsuna, Kanagawa (JP); Kouichi Harada, Tokyo (JP); Maki Yonetsu, Tokyo (JP); Seiichi Suenaga, Kanagawa (JP); Naoto Ito, Tokyo (JP); Akihiro Tsujimura, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 531 days.

(21) Appl. No.: 12/411,101

(22) Filed: Mar. 25, 2009

(65) Prior Publication Data

US 2010/0060538 A1 Mar. 11, 2010

(30) Foreign Application Priority Data

Sep. 8, 2008 (JP) ..... 2008-229295

(51) Int. Cl.
*H01Q 1/00* (2006.01)

(52) U.S. Cl. ..... 343/787; 343/895

(58) Field of Classification Search ..... 343/787, 343/895; 252/62.5

See application file for complete search history.

(56) References Cited

U.S. PATENT DOCUMENTS

| | | | | |
|---|---|---|---|---|
| 5,255,001 | A * | 10/1993 | Tamura et al. | 343/702 |
| 7,285,329 | B2 | 10/2007 | Kaneko et al. | |
| 2004/0046699 | A1 * | 3/2004 | Amano et al. | 343/702 |
| 2007/0263681 | A1 * | 11/2007 | Yoshitomi et al. | 372/25 |
| 2007/0273600 | A1 | 11/2007 | Tsujimura et al. | |
| 2008/0220231 | A1 | 9/2008 | Suetsuna et al. | |
| 2009/0021444 | A1 | 1/2009 | Aiga et al. | |
| 2009/0040112 | A1 | 2/2009 | Sekine et al. | |

FOREIGN PATENT DOCUMENTS

| | | |
|---|---|---|
| JP | 2002-57020 | 2/2002 |
| JP | 2003-332116 | 11/2003 |

(Continued)

OTHER PUBLICATIONS

U.S. Appl. No. 12/410,768, filed Mar. 25, 2009, to Suetsuna, entitled Antenna Device.

(Continued)

*Primary Examiner* — Jacob Y Choi
*Assistant Examiner* — Kyana R McCain
(74) *Attorney, Agent, or Firm* — Finnegan, Henderson, Farabow, Garrett & Dunner, L.L.P.

(57) ABSTRACT

The present invention provides a core-shell magnetic material having an excellent characteristic in a high frequency band, particularly, in a GHz band. The core-shell magnetic material includes: core-shell magnetic particles including magnetic metal particles and an oxide coating layer, the magnetic metal particle containing magnetic metal selected from the group of Fe, Co, and Ni, nonmagnetic metal selected from the group of Mg, Al, Si, Ca, Zr, Ti, Hf, Zn, Mn, a rare-earth element, Ba, and Sr, and an element selected from carbon and nitrogen, and the oxide coating layer being made of an oxide containing at least one nonmagnetic metal as one of the components of the magnetic metal particle; and oxide particles existing at least a part between the magnetic metal particles and containing nonmagnetic metal selected from the group of Mg, Al, Si, Ca, Zr, Ti, Hf, Zn, Mn, a rare-earth element, Ba, and Sr, and in which nonmagnetic metal/magnetic metal (atomic ratio) in the particles is higher than that in the oxide coating layer.

10 Claims, 6 Drawing Sheets

FOREIGN PATENT DOCUMENTS

| | | |
|---|---|---|
| JP | 2004-235949 | 8/2004 |
| JP | 2005-60805 | 3/2005 |
| JP | 2006-97123 | 4/2006 |
| JP | 2007-124696 | 5/2007 |
| JP | 2008-60506 | 3/2008 |
| JP | 2008-69431 | 3/2008 |
| JP | 2008-172257 | 7/2008 |

OTHER PUBLICATIONS

U.S. Appl. No. 12/351,235, filed Jan. 9, 2009, to Higaki, entitled Antenna Device and Wireless Communication Device.

U.S. Appl. No. 12/406,575, filed Mar. 18, 2009, to Harada, entitled High-Frequency Magnetic Material and Method of Manufacturing the Same.

Suetsuna et al., U.S. Appl. No. 12/412,249, filed Mar. 26, 2009, entitled Core-Shell Magnetic Material, Method of Manufacturing Core-Shell Magnetic Material, Device and Antenna Device.

Notification of Reason(s) for Refusal issued by the Japanese Patent Office on Nov. 15, 2011, for Japanese Patent Application No. 2008-229295, and English-language translation thereof.

* cited by examiner

CORE-SHELL MAGNETIC MATERIAL, METHOD OF MANUFACTURING CORE-SHELL MAGNETIC MATERIAL, DEVICE, ANTENNA DEVICE, AND PORTABLE DEVICE

CROSS-REFERENCE TO RELATED APPLICATION

This application is based upon and claims the benefit of priority from Japanese Patent Applications No. 2008-229295, filed on Sep. 8, 2008, the entire contents of which are incorporated herein by reference.

FIELD OF THE INVENTION

The present invention relates to a high-frequency core-shell magnetic material, a method of manufacturing a core-shell magnetic material, a device using the core-shell magnetic material, an antenna device, and a portable device.

BACKGROUND OF THE INVENTION

In recent years, magnetic materials are applied to electromagnetic wave absorbers, magnetic inks and devices such as an inductance element, and their importance is increasing year after year. Those parts use the characteristics of a magnetic permeability real part (relative magnetic permeability real part) μ' and a magnetic permeability imaginary part (relative magnetic permeability imaginary part) μ" of a magnetic material in accordance with a purpose. For example, an inductance element uses high μ' (and low μ") and an electromagnetic wave absorber uses high μ". Consequently, in the case of actually using the characteristics in a device, μ' and μ" have to be controlled in accordance with a frequency band used by the device. In recent years, the frequency bands used by devices are high, so that a technique of manufacturing a material capable of controlling μ' and μ" at high frequencies is in strong demand.

As the magnetic materials for an inductance element used at high frequencies of 1 MHz or higher, ferrite and amorphous alloys are mainly used. The magnetic materials do not have a loss (low μ"), have high μ', and display excellent magnetic characteristics in the range of 1 MHz to 10 MHz. However, the magnetic permeability real part μ' of the magnetic materials drops in a higher frequency range of 10 MHz or higher, and satisfactory characteristics are not always obtained.

Development of an inductance element using the thin film technique such as sputtering and plating is also actively performed, and it is confirmed that the inductance element displays excellent characteristics also in a high frequency band. However, large equipment is necessary for the thin film technique such as sputtering, and film thickness and the like has to be controlled precisely. Therefore, the method is not always sufficiently satisfactory from the viewpoints of cost and yield. The inductance element obtained by the thin film technique also has a problem that thermal stability for long time of magnetic characteristics at high temperature and high moisture is insufficient.

A magnetic material having high μ' and low μ" in a high frequency band is expected to be applied to a device of high frequency communication equipment such as an antenna device. A present portable communication terminal performs most of information propagations by transmitting/receiving electrical waves. The frequency band of electrical waves presently used is a high frequency band of 100 MHz or higher. Attention is therefore being paid to electronic parts and substrates useful in the high frequency band. In a portable mobile communication and a satellite communication, electrical waves in a high frequency band such as GHz band are used.

To handle the electrical waves in such a high frequency band, energy loss and transmission loss in an electronic part have to be small. For example, in an antenna indispensable for a portable communication terminal, a transmission loss occurs in a transmitting process. The transmission loss is unpreferable since electrical waves are consumed as thermal energy in an electronic part and a substrate and causes heat generation in the electronic part. As a result, electrical waves to be transmitted to the outside are cancelled each other out. Consequently, electrical waves stronger than necessary have to be transmitted, and there is a problem from the viewpoint of effective use of power. The more the antenna is miniaturized, the more the problem of the transmission losses becomes conspicuous.

In recent years, with increasing demands for smaller and lighter communication devices, electronic parts are becoming smaller and spaces are being reduced. Despite this, it is necessary for an antenna to assure some distance from an electronic part and a substrate in order to suppress transmission loss for the above-described reason. Consequently, an unnecessary space has to be provided, and a problem arises that it is difficult to reduce the space.

To address the problem, an antenna using dielectric ceramics is developed. By achieving miniaturization of an antenna, the space can be reduced. However, since the dielectric material has dielectric loss, the transmission loss becomes large, and transmission/reception sensitivity cannot be obtained. Under present condition, the antenna is used as an auxiliary antenna, and there is a limitation. The dielectric material tends to narrow the resonance frequency band of an antenna, so that it is unpreferable to use dielectric material for a wide-band antenna.

As a method of miniaturizing an antenna and saving power, there is a method of performing transmission/reception by passing electrical waves, which are to arrive at electrical parts and a substrate of communication devices from the antenna, to an insulating substrate of high magnetic permeability (high μ' and low μ") without passing the electrical waves to the electrical parts and the substrate. The method is more preferable for the reason that miniaturization of the antenna and power saving can be realized and, simultaneously, the band of the resonance frequency of the antenna can be widened.

A normal high magnetic permeability material is a metal or alloy. Since the normal high magnetic permeability materials are metals, electrical resistance is low, and the antenna characteristic deteriorates. Consequently, the materials cannot be used. In the case of using the high magnetic permeability material for an antenna substrate, the high magnetic permeability material has to have high insulting property.

On the other hand, in the case of using the high magnetic permeability material of an insulating oxide typified by ferrite for an antenna substrate, deterioration in the antenna characteristics caused by low electrical resistance can be suppressed. However, at high frequencies of a few hundreds Hz, the frequencies are close to resonance frequency, a transmission loss due to resonance becomes conspicuous, and the high magnetic permeability material cannot be used.

In the case of using the high magnetic permeability material for an antenna substrate, the thickness of the material of 10 μm or more, preferably, 100 μm or more is necessary. Under the present set of circumstances, there is no insulating high magnetic permeability material with high permeability in a high frequency band, particularly, in a GHz band, and having a thickness of 10 μm or more, preferably, 100 μm or more. Consequently, as the material of the antenna substrate, an insulating high magnetic permeability material (high μ' and low μ") in which transmission loss is suppressed as much as possible and which can be used for electrical waves of high frequencies is demanded.

On the other hand, an electromagnetic absorber absorbs noise which occurs as the frequency of an electronic device becomes higher by using high μ", thereby reducing inconveniences such as erroneous operation of the electronic device. Examples of the electronic device are a semiconductor device such as an IC chip and various communication devices. There are various electronic devices used in high frequency band from 1 MHz to a few GHz, further, tens GHz or higher.

Particularly, in recent years, there is a tendency that electronic devices used in the high frequency band of 1 GHz or higher increase. An electromagnetic wave absorber of an electronic device used in a high frequency band is conventionally manufactured by mixing ferrite particles, carbonyl iron particles, FeAlSi flakes, FeCrAl flakes, or the like with a resin as a binder. However, μ' and μ" of those materials are extremely low in a high frequency band of 1 GHz or higher, and satisfactory characteristics are not always obtained. A material combined by the mechanical alloying method or the like lacks thermal stability for long hours and has a problem that the yield is low.

JP-A 2006-97123 (KOKAI) discloses, as a magnetic material for use at high frequencies, a core-shell magnetic material in which metal particles are coated with an inorganic material in multiple layers.

SUMMARY OF THE INVENTION

A core-shell magnetic material according to an embodiment of the present invention includes: core-shell magnetic particles including magnetic metal particles and an oxide coating layer for coating surface of at least a part of the magnetic metal particles, the magnetic metal particle containing at least one magnetic metal selected from the group of Fe, Co, and Ni, at least one nonmagnetic metal selected from the group of Mg, Al, Si, Ca, Zr, Ti, Hf, Zn, Mn, a rare-earth element, Ba, and Sr, and at least one element selected from carbon and nitrogen, and the oxide coating layer being made of an oxide containing at least one nonmagnetic metal contained in the magnetic metal particle; and oxide particles existing at least in a part of space between the magnetic metal particles and containing at least one nonmagnetic metal selected from the group of Mg, Al, Si, Ca, Zr, Ti, Hf, Zn, Mn, a rare-earth element, Ba, and Sr, and in which nonmagnetic metal/magnetic metal (atomic ratio) in the particles is higher than that in the oxide coating layer.

A method of manufacturing a core-shell magnetic material, according to an embodiment of the present invention includes: a step of manufacturing magnetic metal particles made of magnetic metal and nonmagnetic metal; a step of coating surface of the magnetic metal particles with carbon; a step of performing heat treatment on the magnetic metal particles coated with carbon under reducing atmosphere to convert carbon to hydrocarbon; and a step of oxidizing the magnetic metal particles. The magnetic metal is at least one magnetic metal selected from the group of Fe, Co, and Ni, and the nonmagnetic metal is at least one nonmagnetic metal selected from the group of Mg, Al, Si, Ca, Zr, Ti, Hf, Zn, Mn, a rare-earth element, Ba, and Sr.

A device according to an embodiment of the present invention includes a core-shell magnetic material containing: core-shell magnetic particles including magnetic metal particles and an oxide coating layer for coating surface of at least a part of the magnetic metal particles, the magnetic metal particle containing at least one magnetic metal selected from the group of Fe, Co, and Ni, at least one nonmagnetic metal selected from the group of Mg, Al, Si, Ca, Zr, Ti, Hf, Zn, Mn, a rare-earth element, Ba, and Sr, and at least one element selected from carbon and nitrogen, and the oxide coating layer being made of an oxide containing at least one nonmagnetic metal contained in the magnetic metal particle; and oxide particles existing at least in a part of space between the magnetic metal particles, containing at least one nonmagnetic metal selected from the group of Mg, Al, Si, Ca, Zr, Ti, Hf, Zn, Mn, a rare-earth element, Ba, and Sr, and in which nonmagnetic metal/magnetic metal (atomic ratio) in the particles is higher than that in the oxide coating layer.

An antenna device according to an embodiment of the present invention includes a core-shell magnetic material containing: core-shell magnetic particles including magnetic metal particles and an oxide coating layer for coating surface of at least a part of the magnetic metal particles, the magnetic metal particle containing at least one magnetic metal selected from the group of Fe, Co, and Ni, at least one nonmagnetic metal selected from the group of Mg, Al, Si, Ca, Zr, Ti, Hf, Zn, Mn, a rare-earth element, Ba, and Sr, and at least one element selected from carbon and nitrogen, and the oxide coating layer being made of an oxide containing at least one nonmagnetic metal contained in the magnetic metal particle; and oxide particles existing at least in a part of space between the magnetic metal particles, containing at least one nonmagnetic metal selected from the group of Mg, Al, Si, Ca, Zr, Ti, Hf, Zn, Mn, a rare-earth element, Ba, and Sr, and in which nonmagnetic metal/magnetic metal (atomic ratio) in the particles is higher than that in the oxide coating layer.

A portable device according to an embodiment of the present invention includes: a wiring board; a spiral antennal element connected to a power feeding terminal provided for the wiring board; and a magnetic material provided on the inside of the antenna element. The magnetic material is a core-shell magnetic material containing: core-shell magnetic particles including magnetic metal particles and an oxide coating layer for coating surface of at least a part of the magnetic metal particles, the magnetic metal particle containing at least one magnetic metal selected from the group of Fe, Co, and Ni, at least one nonmagnetic metal selected from the group of Mg, Al, Si, Ca, Zr, Ti, Hf, Zn, Mn, a rare-earth element, Ba, and Sr, and at least one element selected from carbon and nitrogen, and the oxide coating layer being made of an oxide containing at least one nonmagnetic metal contained in the magnetic metal particle; and oxide particles existing at least in a part of space between the magnetic metal particles, containing at least one nonmagnetic metal selected from the group of Mg, Al, Si, Ca, Zr, Ti, Hf, Zn, Mn, a rare-earth element, Ba, and Sr, and in which nonmagnetic metal/magnetic metal (atomic ratio) in the particles is higher than that in the oxide coating layer.

The present invention can provide a core-shell magnetic material having an excellent characteristic in a high frequency band, particularly, in a GHz band, a method of manufacturing the core-shell magnetic material, a device, an antenna device, and a portable device.

DETAILED DESCRIPTION OF THE EMBODIMENTS

Figure 1A:
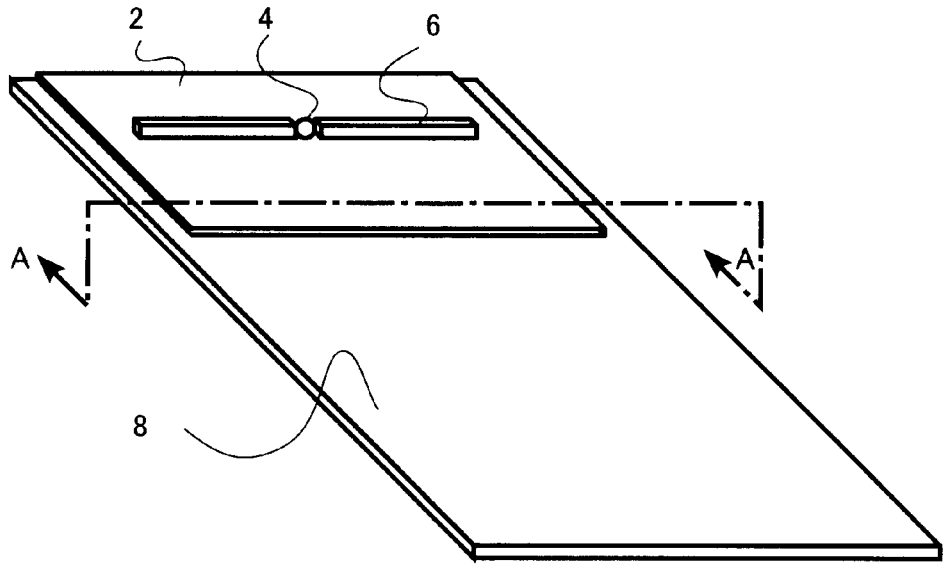
FIGS. 1A and 1B are configuration diagrams of an antenna device of a fifth embodiment.

Embodiments of the present invention will be described below with reference to the drawings.

(First Embodiment)

A core-shell magnetic material according to an embodiment of the present invention includes core-shell magnetic particles and oxide particles. The core-shell magnetic particle includes a magnetic metal particle (core) and an oxide coating layer (shell) for coating surface of at least a part of the magnetic metal particle. The magnetic metal particle contains at least one magnetic metal selected from the group of Fe, Co, and Ni, at least one nonmagnetic metal selected from the group of Mg, Al, Si, Ca, Zr, Ti, Hf, Zn, Mn, a rare-earth element, Ba, and Sr, and at least one element selected from carbon and nitrogen. The oxide coating layer is made of an oxide containing at least one nonmagnetic metal contained in the magnetic metal particle. Oxide particles exist at least in a part of space between the magnetic metal particles and containing at least one nonmagnetic metal selected from the group of Mg, Al, Si, Ca, Zr, Ti, Hf, Zn, Mn, a rare-earth element, Ba, and Sr. Nonmagnetic metal/magnetic metal (atomic ratio) in the oxide particles is higher than that in the oxide coating layer.

With the configuration, the core-shell magnetic material having an excellent characteristic in a high frequency band, particularly, in the GHz band is realized. Concretely, high magnetic permeability (high $\mu'$ and low $\mu''$) and insulation performance in a desired high frequency band can be realized. For example, a magnetic material with extremely suppressed transmission loss which is preferable for an antenna device is provided. A magnetic material having an excellent absorption characteristic suitable for a radio wave absorber in a desired high-frequency band is provided. Further, a magnetic material having excellent thermal stability in the magnetic characteristic for long time is provided.

The magnetic metal contained in the magnetic metal particle includes at least one metal selected from the group of Fe, Co, and Ni. Particularly, an Fe-based alloy, a Co-based alloy, and an FeCo-based alloy are preferable since they can realize high saturation magnetization. Examples of the Fe-based alloy are an FeNi alloy, an FeMn alloy, and an FeCu alloy containing Ni, Mn, and Cu, respectively, as a second component. Examples of the Co-based alloy are a CoNi alloy, a CoMn alloy, and a CoCu alloy containing Ni, Mn, and Cu, respectively, as a second component. Examples of the FeCo-based alloy are alloys containing Ni, Mn, Cu, and the like as a second component. The second components are components effective to improve the high-frequency magnetic characteristic of the core-shell magnetic particle.

It is particularly preferable to use an FeCo-based alloy among magnetic metals. Preferably, the amount of Co in FeCo lies in the range of 10 atomic % to 50 atomic % from the viewpoint of satisfying high thermal stability, high oxidation resistance, and saturation magnetization of 2 tesla or greater. More preferably, the amount of Co in FeCo lies in the range of 20 atomic % to 40 atomic % from the viewpoint of further improving saturation magnetization.

The nonmagnetic metal contained in the magnetic metal particle is at least one metal selected from the group of Mg, Al, Si, Ca, Zr, Ti, Hf, Zn, Mn, a rare-earth element, Ba, and Sr. The nonmagnetic metals are elements which have small standard Gibbs free energy of formation of an oxide and are easily oxidized. The nonmagnetic metals are contained as one of components of the oxide coating layer for coating the magnetic metal particles, and can stably provide insulation performance and improve thermal stability and oxidation resistance. Among them, Al and Si are preferable since they are easily solved with Fe, Co, and Ni as main components of the magnetic metal particles in a solid solution state, and contribute to improve thermal stability and oxidation resistance of the core-shell magnetic particle. In particular, it is preferable to use Al since thermal stability and oxidation resistance becomes higher.

In the magnetic metal particle, carbon and/or nitrogen is contained. At least one of carbon and nitrogen is solved with the magnetic metal, thereby enabling the magnetic anisotropy of the core-shell magnetic particle to be increased. The high-frequency magnetic material containing the core-shell magnetic particle having such large magnetic anisotropy can make ferromagnetic resonance frequency higher, so that high magnetic permeability can be maintained also in a high frequency band, and the material is suitable for use in the high frequency band.

Preferably, the magnetic metal particle contains, in addition to the magnetic metal, 0.001 atomic % to 20 atomic % of the nonmagnetic metal and at least one element selected from carbon and nitrogen (when they coexist, mixture of carbon and nitrogen) with respect to the magnetic metal. When the content of the nonmagnetic metal and at least one element selected from carbon and nitrogen exceeds 20 atomic %, there is the possibility that saturation magnetization of the magnetic particle deteriorates. A more preferable amount from the viewpoints of high saturation magnetization and solid solution state mixture lies in the range of 0.001 atomic % to 5 atomic % and, further more preferably, in the range of 0.01 atomic % to 5 atomic %.

Particularly, in the magnetic metal particle containing an FeCo-based alloy as the magnetic metal and carbon (C) as an element selected from carbon and nitride, preferably, at least one element selected from Al and Si is contained. Preferably, at least one element selected from Al and Si (when they coexist, mixture of Al and Si) is contained in the range of 0.001 atomic % to 5 atomic %, more preferably, 0.01 atomic % to 5 atomic % of FeCo. Carbon is contained in the range of 0.001 atomic % to 5 atomic %, more preferably, 0.01 atomic % to 5 atomic % of FeCo. In the case where the magnetic metal is an FeCo-based alloy and contains at least one element selected from Al and Si and carbon, and each of at least one element selected from Al and Si and carbon is contained in the range of 0.001 atomic % to 5 atomic %, particularly, magnetic anisotropy and saturation magnetization can be maintained excellently. As a result, magnetic permeability at high frequencies can be made high.

The composition analysis of the magnetic metal particle can be performed by, for example, the following method. For analysis of the nonmagnetic metal such as Al, the ICP emission spectrometry, TEM-EDX, XPS, SIMS, or the like can be used. In the ICP emission spectrometry, by comparing analysis results of a magnetic metal particle (core) part dissolved with weak acid or the like, a residual (oxide shell) dissolved with alkali, strong acid, or the like, and the entire particle, the composition of the magnetic metal particle can be recognized. That is, the amount of the nonmagnetic metal in the magnetic metal particle can be measured.

In the TEM-EDX, an EDX is emitted while narrowing a beam to the magnetic metal particle (core) and the oxide coating layer (shell) and the semi-quantitative analysis is performed, thereby enabling the composition of the magnetic metal particle to be roughly recognized. Further, by the XPS, a coupling state of elements of the magnetic metal particle can be also examined. For example, it is hard for an element such as carbon to be solved in the shell part. Consequently, it is considered that the element is solved on the core side as the magnetic metal particle. By analyzing the composition of the entire magnetic metal particle by the ICP emission spectrometry, the element can be measured. By such a magnetic metal particle composition analysis, a small amount of the nonmagnetic metal such as Al or Si or the element such as carbon in the magnetic metal particle can be measured.

Preferably, at least two elements of the magnetic metal, the nonmagnetic metal, and at least one element selected from carbon and nitrogen which are included in the magnetic metal particle are solved with each other. By making the solid solution, magnetic anisotropy can be effectively improved, so that the high frequency magnetic characteristic can be improved. In addition, the mechanical characteristic of the core-shell magnetic particle can be improved. That is, when the elements are not solved but segregate on the grain boundary and the surface of the magnetic metal particle, it may become difficult to effectively improve the mechanical characteristic.

Whether at least two elements out of the magnetic metal, the nonmagnetic metal, and at least one element selected from carbon and nitrogen which are included in the magnetic metal particle are solved or not can be determined from a lattice constant measured by XRD (X-ray Diffraction). For example, when Fe as the magnetic metal, Al as the nonmagnetic metal, and carbon which are included in the magnetic metal particle are solved, the lattice constant of Fe changes according to the solid solubility. In the case of bcc-Fe in which nothing is solved, the lattice constant is ideally about 2.86. When Al is solved, the lattice constant increases. When about 5 atomic % of Al is solved, the lattice constant increases by about 0.005 to 0.01. When about 10 atomic % of Al is solved, the lattice constant increases by about 0.01 to 0.02. Also in the case where carbon is solved in bcc-Fe, the lattice constant increases. When about 0.02 wt % of carbon is solved, the lattice constant increases by about 0.001. In such a manner, by measuring the magnetic metal particle by XRD, the lattice constant of the magnetic metal is obtained. Whether the elements are solved or not and the solid solubility can be easily determined according to the lattice constant. Whether the elements are solved or not can be also recognized from a diffraction pattern of particles by TEM and a high-resolution TEM photograph.

The crystal structure of the magnetic metal is slightly distorted as the particle diameter of the magnetic metal particle decreases, or by employing a core-shell structure made of a magnetic metal particle and an oxide coating layer. When the size of the magnetic metal as a core decreases, or when the core-shell structure is employed, distortion occurs in the interface between the core and the shell. The lattice constant has to be determined comprehensively including such an effect. Specifically, in the case of a combination of Fe, Al, and C, as described above, the mixture of 0.01 atomic % to 5 atomic % of each of Al and C is most preferable and, more preferably, the elements are in a solid solution state. When the elements are solved in a solid solution state and employ the core-shell structure of the particles and the coating layer, the lattice constant of Fe becomes, preferably, about 2.86 to 2.90 and, more preferably, about 2.86 to 2.88.

In the case of the combination of FeCo, Al, and C, as described above, most preferably, the amount of Co contained in FeCo lies in the range of 20 atomic % to 40 atomic %, and the amount of each of Al and C lies in the range of 0.01 atomic % to 5 atomic % and, more preferably, the elements are solved in a solid solution state. When the elements are solved in a solid solution state and employ the core-shell structure of the particles and the coating layer, the lattice constant of FeCo becomes, preferably, about 2.85 to 2.90 and, more preferably, about 2.85 to 2.88.

The magnetic metal particle may be in the form of polycrystal or single crystal. Preferably, the magnetic metal particle is in the form of single crystal. At the time of integrating the core-shell magnetic particles including magnetic metal particles of single crystal to form a high-frequency magnetic material, axis of easy magnetization can be aligned and magnetic anisotropy can be controlled. Therefore, the high frequency characteristic can be improved as compared with a high-frequency magnetic material containing core-shell magnetic particles including magnetic metal particles of polycrystal.

Average particle diameter of the magnetic metal particle is 1 nm to 1,000 nm, preferably, 1 nm to 100 nm, and more preferably, 10 nm to 50 nm. When the average particle diameter is less than 10 nm, there is the possibility that super paramagnetism occurs and flux content decreases. On the other hand, when the average particle diameter exceeds 1,000 nm, there is the possibility that an eddy-current loss increases in the high-frequency band and the magnetic characteristic in the target high frequency band deteriorates. In the core-shell magnetic particle, when the particle diameter of the magnetic metal particle increases, a magnetic metal particle having a multiple-magnetic-domain structure is stabler than that having a single-domain structure from the viewpoint of energy. The high frequency characteristic of the magnetic permeability of the core-shall magnetic particle including the magnetic metal particle having the multiple-magnetic-domain structure is lower than that including the magnetic metal particle having the single-domain structure.

For such a reason, in the case of using the core-shell magnetic particle as a magnetic material for high frequencies, preferably, it exists as a magnetic metal particle having the single-domain structure. Since the critical particle diameter of the magnetic metal particle having the single-domain structure is about 50 nm or less, it is preferable to set the average particle diameter of the magnetic metal particle to 50 nm or less. Based on the above points, average particle diameter of the magnetic metal particle is 1 nm to 1,000 nm, preferably, 1 nm to 100 nm, and more preferably, 10 nm to 50 nm.

The magnetic metal particle may have a spherical shape but preferably has a flat shape or a rod shape having a high aspect ratio (for example, 10 or greater). The rod shape includes a spheroid. The "aspect ratio" refers to the ratio of height to diameter (height/diameter). In the case of a spherical shape, the height and the diameter are equal to each other, so that the aspect ratio is 1. The aspect ratio of a flat-shaped particle refers to "diameter/height". The aspect ratio of the rod shape refers is "length of the rod/diameter of the bottom face of the rod". The aspect ratio of a spheroid refers to "long axis/short axis".

When the aspect ratio is set to be high, magnetic anisotropy by the shape can be given, and the high frequency characteristic of the magnetic permeability can be improved. Moreover, at the time of fabricating a desired material by integrating core-shell magnetic particles, the particles can be easily aligned by a magnetic field. Further, the high frequency characteristic of the magnetic permeability can be improved. By setting the aspect ratio to be high, the critical particle diameter of the magnetic metal particle having the single-domain structure can be increased to, for example, a value exceeding 50 nm. In the case of a spherical magnetic metal particle, the critical particle diameter in the single-domain structure is about 50 nm.

The critical particle diameter of the flat magnetic metal particle having a high aspect ratio can be increased, and the high frequency characteristic of the magnetic permeability does not deteriorate. Generally, particles having a larger particle diameter are synthesized more easily. Therefore, from the viewpoint of manufacture, a particle having a high aspect ratio is advantageous. Further, by setting the aspect ratio to be higher, at the time of manufacturing a desired material by integrating the core-shell magnetic particles including the magnetic metal particles, the filling rate can be increased. Consequently, saturation magnetization per volume and per weight of a material can be increased. As a result, the magnetic permeability can be set to be higher.

An oxide coating layer for coating the surface of at least a part of the magnetic metal particles is made of an oxide or composite oxide containing at least one non-magnetic metal as one of the components of the magnetic metal particle. The oxide coating layer improves oxidation resistance of an internal magnetic metal particle. In addition, at the time of manufacturing a desired material by integrating the core-shell magnetic particles coated with the oxide coating layer, the magnetic particles are electrically isolated and the electrical resistance of the material can be increased. By increasing the electrical resistance of the material, an eddy-current loss at high frequencies is suppressed, and the high frequency characteristic of the magnetic permeability can be improved. Consequently, the oxide coating layer has, preferably, electrically high resistance. Preferably, the oxide coating layer has a electrical resistance value of, for example, 1 mΩ·cm or higher.

At least one non-magnetic metal selected from the group of Mg, Al, Si, Ca, Zr, Ti, Hf, Zn, Mn, rare-earth element, Ba, and Sr is an element having small standard Gibbs free energy of formation of the oxidation and is easily oxidized. With the oxide coating layer made of such an oxide or a composite oxide containing at least one non-magnetic metal, adhesion and bonding to the magnetic metal particle can be improved, and thermal stability of the magnetic metal particle can be also improved. Al and Si among the nonmagnetic metals are preferable since they are easily solved with Fe, Co, and Ni as main components of the magnetic metal particle, so that it contributes to improvement in the thermal stability of the core-shell magnetic particle. The invention includes a solid solution state form of a composite oxide containing a plurality of kinds of non-magnetic metals.

The oxide coating layer has, preferably, a thickness of 0.1 nm to 100 nm and, more preferably, a thickness of 0.1 nm to 20 nm. When the thickness of the oxide coating layer is less than 0.1 nm, oxidation resistance is insufficient. At the time of integrating the core-shell magnetic particles coated with the oxide coating layer to manufacture a desired material, the electrical resistance of the material decreases, eddy-current loss tends to occur, and there is the possibility that the high-frequency property of the magnetic permeability deteriorates. On the other hand, when the thickness of the oxide coating layer exceeds 100 nm, at the time of integrating the core-shell magnetic particles coated with the oxide coating layer to produce a desired material, the filling rate of the magnetic metal particles included in the material decreases only by the amount of thickness of the oxide coating layer. There is the possibility that saturation magnetization of the material decreases, and magnetic permeability drops.

Oxide particles existing at least in a part of space between the magnetic metal particles are made of an oxide or composite oxide containing at least one nonmagnetic metal. Existence at least in a part of space between magnetic metal particles (cores) means that the oxide particle may exist between cores in direct contact with the cores or between shells in direct contact with the shells.

Like the oxide coating layer, the oxide particle can improve oxidation resistance, agglomeration suppression power of the magnetic metal particle, that is, thermal stability of the magnetic metal particle. In addition, at the time of manufacturing a desired material by integrating the core-shell magnetic particles coated with the oxide coating layer, the magnetic particles are electrically isolated and the electrical resistance of the material can be increased. By increasing the electrical resistance of the material, an eddy-current loss at high frequencies is suppressed, and the high frequency characteristic of the magnetic permeability can be improved. Consequently, the oxide particle has, preferably, electrically high resistance. Preferably, the oxide particle has an electrical resistance value of, for example, 1 mΩ·cm or higher.

The oxide particle contains at least one nonmagnetic metal selected from the group of Mg, Al, Si, Ca, Zr, Ti, Hf, Zn, Mn, a rare-earth element, Ba, and Sr. The nonmagnetic metal is an element having small standard Gibbs free energy of formation of the oxide and is easily oxidized, so that a stable oxide can be easily generated. Nonmagnetic metal/magnetic metal (atomic ratio) in the oxide particle is higher than that in the oxide coating layer. As described above, since the ratio of the nonmagnetic metal is high, the oxide particle is thermally stabler than the oxide coating layer. Therefore, by the existence of the oxide particle at least in a part of space between the magnetic metal particles, electrical insulation between the magnetic metal particles can be further improved, and thermal stability of the magnetic metal particles can be improved.

More preferably, the oxide particle contains a nonmagnetic metal of the same kind as that of the nonmagnetic metal contained in the magnetic metal particle, that is, the same kind as that of the nonmagnetic metal contained in the oxide coating layer. By the oxide particle containing the nonmagnetic metal of the same kind, thermal stability of the magnetic metal particle further improves.

The average particle diameter of the oxide particles is, preferably, 1 nm to 100 nm. More preferably, the particle diameter of the oxide particle is smaller than that of the magnetic metal particle. When the average particle diameter is 1 nm or less, electrical insulation between the magnetic metal particles and thermal stability of the magnetic metal particle is insufficient and it is not preferable. When the average particle diameter is 100 nm or larger, it is unpreferable for the reason that the ratio of the oxide particles contained in the core-shell magnetic material increases, that is, the ratio of the magnetic metal particles contained in the entire core-shell magnetic material decreases, and it may cause deterioration in the saturation magnetization of the material and, accordingly, deterioration in the magnetic permeability. Also in the case where the particle diameter of the oxide particle is larger than that of the magnetic metal particle, it is similarly unpreferable for the reason that deterioration in the saturation magnetization of the material and, accordingly, deterioration in the magnetic permeability may be caused. From the above, preferably, the average particle diameter of the oxide particle is 1 nm to 100 nm and, more preferable, the particle diameter of the oxide particle is smaller than that of the magnetic metal particle.

To obtain the effect of improving the high-frequency characteristic of the core-shell magnetic material by the oxide particle, a number of oxide particles have to exist in the space between the magnetic metal particles in the core-shell magnetic material. The number of oxide particles varies according to the particle diameter of the magnetic metal particle and the particle diameter of the oxide particle. As a guide, the number of oxide particles is larger than 10% of that of the core-shell magnetic particles. However, when the number of oxide particles is much larger than that of the core-shell magnetic particles, deterioration in the saturation magnetization is caused by decrease in the magnetic metal particles and, accordingly, the magnetic permeability deteriorates. Consequently, preferably as a guide, the number of oxide particles is less than 200% of the number of core-shell magnetic particles. The numbers are provided for information and vary more or less according to the particle diameter of the magnetic metal particle and the particle diameter of the oxide particle. That is, as described above, although the particle diameter of the oxide particle is preferably smaller than that of the magnetic metal particle. In the case where the ratio between the two particle diameters, that is, (particle diameter of oxide particle)/(particle diameter of magnetic metal particle) is relatively high, the number of oxide particles may be small. In the case where (particle diameter of oxide particle)/(particle diameter of magnetic metal particle) is relatively low, preferably, the number of oxide particles may be large.

In the embodiment, to realize more excellent characteristics, preferably, the composition and thickness of the oxide coating layer and the composition and diameter of the oxide particle are uniform as much as possible.

Examples of the shape of the core-shell magnetic material of the embodiment are powders, bulks (pellets, rings, rectangles, and the like), and films including sheets.

A magnetic sheet contains the core-shell magnetic material and a resin. Preferably, the volume ratio in the entire sheet, of the core-shell magnetic material is 10% to 70%. When the volume ratio exceeds 70%, the electrical resistance of the sheet becomes small, eddy-current loss increases, and there is the possibility that the high-frequency magnetic characteristic deteriorates. When the volume ratio is lower than 10%, the volume fraction of the magnetic metal decreases, saturation magnetization of the magnetic sheet decreases, and there is the possibility that magnetic permeability drops. Preferably, the volume ratio of resin or ceramics lies in the range of 5% to 80%. When the volume ratio is less than 5%, there is the possibility that the particles cannot be bonded to each other and the strength of the sheet deteriorates. When the volume ratio exceeds 80%, there is the possibility that the volume ratio in the entire sheet, of the magnetic metal particles drops, and the magnetic permeability drops.

Though it is not limited, as the resin, polyester resin, polyethylene resin, polystyrene resin, polyvinyl chloride resin, polyvinyl butyral resin, polyurethane resin, cellulosic resin, ABS resin, nitrile-butadiene rubber, styrene-butadiene rubber, epoxy resin, phenol resin, amide resin, imide resin, or copolymers of the resins are used.

In place of the resin, inorganic materials such as oxide, nitride, and carbide may be used. The inorganic material is, concretely, an oxide containing at least one metal selected from the group of Mg, Al, Si, Ca, Zr, Ti, Hf, Zn, Mn, rare-earth element, Ba, and Sr, such as AlN, $Si_3N_4$, SiC or the like.

The method of manufacturing the magnetic sheet is not limited. For example, a magnetic sheet can be manufactured by mixing the core-shell magnetic material, a resin, and a solvent to obtain slurry, and applying and drying the slurry. It is also possible to press a mixture of the core-shell magnetic material and a resin and form the mixture in a sheet shape or pellet shape. Further, the core-shell magnetic material may be dispersed in a solvent and deposited by a method such as electrophoresis.

The magnetic sheet may have a stack structure. By the stack structure, the magnetic sheet can be easily made thick. By alternately stacking the magnetic sheet and a nonmagnetic insulating layer, the high-frequency magnetic characteristic can be improved. To be specific, a magnetic layer containing the core-shell magnetic material is formed in a sheet having a thickness of 100 μm or less. The sheet-shaped magnetic layer is alternately stacked with a non-magnetic insulating oxide layer having a thickness of 100 μm or less to form a stack structure. By the stack structure, the high-frequency magnetic characteristic improves. That is, by setting the thickness of a single magnetic layer to 100 μm or less, when high-frequency magnetic field is applied in the in-plane direction, the influence of the demagnetizing field can be reduced, the magnetic permeability can be increased, and the high-frequency characteristic of magnetic permeability improves. The stacking method is not limited. A plurality of magnetic sheets can be stacked by being pressure-bonded by a method such as press, heated, and sintered.

In the above-described core-shell magnetic material, the magnetic metal particle containing a magnetic metal containing at least one element selected from the group of Fe, Co, and Ni, the nonmagnetic metal, and at least one element selected from carbon and nitrogen has high saturation magnetization and moderately high anisotropy field. An oxide coating layer coated on the surface of the magnetic metal particle and made of an oxide containing at least one nonmagnetic metal as one of the components of the magnetic metal particle, and an oxide particle existing in at least a part of space between the magnetic metal particles have high insulation. As a result, by coating the surface of the magnetic metal particle having high saturation magnetization and having moderately high anisotropy field with the oxide coating layer having high insulation and by making the oxide particles exist between the magnetic metal particles, an eddy-current loss as a cause of a loss at high frequencies can be suppressed, and the core-shell magnetic particle having moderately high anisotropy field can be obtained.

In the core-shell magnetic particle and the high-frequency magnetic material of the embodiment, the material organization can be determined (analyzed) by the SEM (Scanning Electron Microscopy), or TEM (Transmission Electron Microscopy) A diffraction pattern (including recognition of solid solution state mixture) can be analyzed by TEM diffraction or XRD (X-ray Diffraction). Identification of an element and quantitative analysis can be performed by the ICP (Inductively Coupled Plasma) emission analysis, fluorescent X-ray analysis, EPMA (Electron Probe Micro-Analysis), EDX (Energy Dispersive X-ray Fluorescence Spectrometer), SIMS (Secondary Ion Mass Spectrometry), or the like. An average particle diameter of the magnetic metal particle and the oxide particle can be obtained as follows. By TEM observation or SEM observation, the longest diagonal line and the shortest diagonal line of the particles are averaged and the average is used as the particle diameter. The average particle diameter can be obtained from an average of a number of particle diameters. The thickness of the oxide coating layer can be obtained by the TEM observation.

(Second Embodiment)

A method of manufacturing a core-shell magnetic material of a second embodiment includes: a step of manufacturing magnetic metal particles made of magnetic metal and nonmagnetic metal; a step of coating surface of the magnetic metal particles with carbon; a step of performing heat treatment on the magnetic metal particles coated with carbon under reducing atmosphere to convert carbon to hydrocarbon; and a step of oxidizing the magnetic metal particles. The magnetic metal is at least one magnetic metal selected from the group of Fe, Co, and Ni, and the nonmagnetic metal is at least one nonmagnetic metal selected from the group of Mg, Al, Si, Ca, Zr, Ti, Hf, Zn, Mn, a rare-earth element, Ba, and Sr.

In the step of manufacturing the magnetic metal particle and the nonmagnetic metal particle, the thermal plasma method or the like is used. The method of manufacturing the magnetic metal particle using the thermal plasma method will be described below. First, for example, argon (Ar) is injected as gas for generating plasma into a high-frequency induction thermal plasma apparatus to generate plasma. The material of the magnetic metal particle made of magnetic metal powders and nonmagnetic metal powders is injected using Ar as carrier gas. The inlet flow of argon as the gas for generating plasma is not limited.

In this case, magnetic metal powder of at least one magnetic metal selected from the group of Fe, Co, and Ni and powders of at least one nonmagnetic metal selected from the group of Mg, Al, Si, Ca, Zr, Ti, Hf, Zn, Mn, rare-earth element, Ba, and Sr are used.

The step of manufacturing the magnetic metal particle is not limited to the thermal plasma method. However, the thermal plasma method is preferable for the reason that the material organization can be controlled at the nano level and quantity synthesis is possible.

A magnetic metal particle in which nitrogen is solved is also preferable since it has high magnetic anisotropy. To solve nitrogen, a method of introducing nitrogen together with argon as gas for generating plasma or the like can be considered. However, the invention is not limited to the method.

As the step of coating the surface of the magnetic metal particle with carbon, there is a method of introducing hydrocarbon gas such as acetylene gas or methane gas as a material of coating carbon together with the carrier gas in the step of manufacturing the magnetic metal particle and progressing carbon coating by a reaction using the hydrocarbon gas as the material. In the method, the hydrocarbon gas introduced together with the carrier gas for carbon coating is not limited to the acetylene gas or methane gas.

There is also a method of simultaneously spraying a raw material containing carbon and a raw material which becomes the magnetic metal particle. An example of the raw material containing carbon used in the method is pure carbon or the like. However, the invention is not limited to pure carbon.

The above-described two methods are desirable from the viewpoint that the magnetic metal particle can be coated with carbon uniformly and homogeneously. The step of coating the surface of the magnetic metal particle with carbon is not always limited to the two methods.

By the method of coating the surface of the magnetic metal particle with carbon, a particle obtained by coating the magnetic metal particle with carbon is obtained. At this time, carbon exists as a coating layer and also is slightly solved in the magnetic metal particle. It is preferable for the reason that magnetic anisotropy of the magnetic metal particle can be improved.

The step of performing heat treatment on the magnetic metal particles coated with carbon under reducing atmosphere to convert carbon to hydrocarbon produces effects of not only eliminating the carbon coating layer existing on the surface of the magnetic metal particle but also promoting mixture of carbon and nitrogen in a solid solution state by heating. The reducing atmosphere includes, for example, atmosphere of nitrogen or argon containing a reducing gas such as hydrogen, carbon monoxide, methane, or the like, and atmosphere of nitrogen or argon in a state where an object to be heated is covered with a carbon material. A more preferable reducing atmosphere is hydrogen gas atmosphere having a concentration of 50% or higher for the reason that the efficiency of eliminating the carbon coating layer improves.

Preferably, the atmosphere of nitrogen or argon containing the reducing gas is formed by air current, and the flow rate of the air current is 10 mL/min or higher. Heating in the reducing atmosphere is performed at a temperature of, preferably, 100° C. to 800° C. and, more preferably, 400° C. to 800° C. When the heating temperature is set to be less than 100° C., it is feared that progress of reduction reaction is suppressed. On the other hand, when the heating temperature exceeds 800° C., it is feared that agglomeration/particle growth of a precipitated metal particle progresses in short time. The reduction temperature and time are not limited as long as conditions capable of reducing the carbon coating layer are used. The reduction time is determined in consideration of the reduction temperature. For example, it is preferable to set the reduction time in the range of 10 minutes to 10 hours.

In the step of oxidizing the magnetic metal particle, heat treatment is performed under oxidation atmosphere. By the heat treatment, at least one nonmagnetic metal selected from the group of Mg, Al, Si, Ca, Zr, Ti, Hf, Zn, Mn, rare-earth element, Ba, and Sr contained in the magnetic metal particle is oxidized. The nonmagnetic metal is allowed to precipitate on the surface of the magnetic metal particle, thereby forming an oxide coating layer containing the nonmagnetic metal. At least one nonmagnetic metal selected from the group of Mg, Al, Si, Ca, Zr, Ti, Hf, Zn, Mn, rare-earth element, Ba, and Sr is oxidized to form an oxide particle.

The atmosphere used in the oxidizing step is not limited as long as it is an oxidizing atmosphere such as oxygen and $CO_2$. In the case of using oxygen, if oxygen concentration is high, oxidation instantaneously proceeds and there is the possibility that agglomeration occurs due to heat generation or the like. Consequently, oxygen in inactive gas is preferably 5% or less and, more preferably, in the range of 10 ppm to 3%. However, the invention is not limited to the range. The heating temperature is preferably room temperature to 800° C. If the heating temperature exceeds 800° C., it is unpreferable for the reason that agglomeration/particle growth of the magnetic metal particle proceeds in short time, and the magnetic characteristics may deteriorate.

By the manufacturing method as described above, a core-shell magnetic material can be manufactured. The core-shell magnetic material includes: core-shell magnetic particles including magnetic metal particles and an oxide coating layer for coating surface of at least a part of the magnetic metal particles, the magnetic metal particle containing at least one magnetic metal selected from the group of Fe, Co, and Ni, at least one nonmagnetic metal selected from the group of Mg, Al, Si, Ca, Zr, Ti, Hf, Zn, Mn, a rare-earth element, Ba, and Sr, and at least one element selected from carbon and nitrogen, and the oxide coating layer being made of an oxide containing at least one nonmagnetic metal as one of the components of the magnetic metal particle; and oxide particles existing at least in a part of space between the magnetic metal particles and containing at least one nonmagnetic metal selected from the group of Mg, Al, Si, Ca, Zr, Ti, Hf, Zn, Mn, a rare-earth element, Ba, and Sr, and in which nonmagnetic metal/magnetic metal (atomic ratio) in the particles is higher than that in the oxide coating layer.

(Third Embodiment)

A method of manufacturing a core-shell magnetic material of a third embodiment is similar to that of the second embodiment except for the following points. In the step of manufacturing the magnetic metal particle, a magnetic metal particle and a nonmagnetic metal particle are manufactured by simultaneously spraying magnetic metal powders having an average particle diameter of 1 to 10 μm in which a magnetic metal and a nonmagnetic metal are solved in a solid solution state, and nonmagnetic metal powders having an average particle diameter of 1 to 10 μm in thermal plasma, and the nonmagnetic metal in the magnetic metal powders and the nonmagnetic metal powders is at least one nonmagnetic metal selected from the group of Mg, Al, Si, Ca, Zr, Ti, Hf, Zn, Mn, a rare-earth element, Ba, and Sr. Therefore, content overlapping that of the second embodiment will not be repeated.

In the step of manufacturing the magnetic metal particle and the nonmagnetic metal particle, it is preferable to use the thermal plasma method. In this case, magnetic metal powders having an average particle diameter of 1 to 10 μm and in which a magnetic metal containing at least one element selected from the group of Fe, Co, and Ni and at least one nonmagnetic metal selected from the group of Mg, Al, Si, Ca, Zr, Ti, Hf, Zn, Mn, a rare-earth element, Ba, and Sr are solved in a solid solution state are used. The solid solution powders having an average particle diameter of 1 to 10 μm are synthesized by the atomizing method or the like. By using the solid solution powders, the magnetic metal particle having an uniform composition can be synthesized by the thermal plasma method. In a subsequent oxidizing step, an uniform oxide coating layer can be formed on the surface of the magnetic metal particle.

In addition, nonmagnetic metal powders having an average particle diameter of 1 to 10 μm and containing at least one nonmagnetic metal selected from the group of Mg, Al, Si, Ca, Zr, Ti, Hf, Zn, Mn, a rare-earth element, Ba, and Sr are used.

Mixture powders of magnetic metal powders as the solid solution powders and nonmagnetic metal powders are used as a raw material. By simultaneously spraying the magnetic metal powders and the nonmagnetic metal powders in thermal plasma, magnetic metal particles and nonmagnetic metal particles are manufactured.

In the step of oxidizing the magnetic metal particles and the nonmagnetic metal particles, by performing heat treatment in oxidation atmosphere, at least one nonmagnetic metal selected from the group of Mg, Al, Si, Ca, Zr, Ti, Hf, Zn, Mn, rare-earth element, Ba, and Sr contained in the magnetic metal particle is oxidized. The nonmagnetic metal is allowed to precipitate on the surface of the magnetic metal particle, thereby forming an oxide coating layer containing the nonmagnetic metal. At least one nonmagnetic metal selected from the group of Mg, Al, Si, Ca, Zr, Ti, Hf, Zn, Mn, rare-earth element, Ba, and Sr in the nonmagnetic metal particle is oxidized to form an oxide particle. Finally, a core-shell magnetic material containing the core-shell magnetic metal particles in which the oxide coating layer is formed on the surface of the magnetic metal particles and the oxide particles existing between the magnetic metal particles can be synthesized.

Uniformity of the particle diameter and composition of the magnetic metal particle, thickness and composition of the oxide coating layer, and the particle diameter and composition of the oxide particle of the core-shell magnetic material obtained by the above-described manufacturing method improve as compared with those of the second embodiment.

(Fourth Embodiment)

A device of a fourth embodiment is similar to a high-frequency device having the core-shell magnetic material of the first embodiment. Therefore, content overlapping that in the first embodiment will not be described. The device is, for example, a high-frequency magnetic part or radio wave absorber such as an inductor, a choke coil, a filter, or a transformer.

In order to be applied to the device, the core-shell magnetic material is allowed to be variously processed. For example, in the case of a sintered material, mechanical processes such as polishing and cutting are performed. In the case of powders, mixture with an epoxy resin, or a resin such as polybutadiene is performed. If necessary, surface processing is performed. In the case where the high-frequency magnetic part is an inductor, a choke coil, a filter, or a transformer, winding process is performed.

With the device of the fourth embodiment, a device having excellent characteristics particularly in the GHz band can be realized.

(Fifth Embodiment)

An antenna device of a fifth embodiment is an antenna device having the core-shell magnetic material of the first embodiment. Therefore, content overlapping that of the first embodiment will not be described. The antenna device of the embodiment has a power feeding terminal, an antenna element whose one end is connected to the power feeding terminal, a core-shell magnetic material for suppressing transmission loss of electromagnetic wave emitted from the antenna element.

Figure 1B:
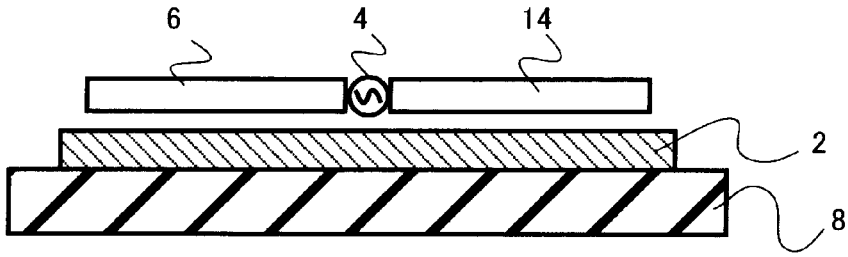

FIGS. 1A and 1B are configuration diagrams of an antenna device of the embodiment. FIG. 1A is a perspective view, and FIG. 1B is a cross section taken along line A-A of FIG. 1A. A core-shell magnetic material 2 is provided between an antenna element 6 having an end to which a power feeding terminal 4 is connected and a wiring board 8. The wiring board 8 is, for example, a wiring board of a portable device and is surrounded by a metal package.

For example, when an antenna of a portable device emits electromagnetic waves, if the antenna and the metal of the package of the portable device or the like come close to each other more than a predetermined distance, the emission of electromagnetic waves is disturbed by induced current generated in the metal. However, by disposing the core-shell magnetic material near the antenna, even when the antenna and the metal of the package or the like come close to each other, no induced current is generated, electrical wave communication can be stabilized, and the portable device can be miniaturized.

By inserting the core-shell magnetic material 2 between the two antenna elements 6 sandwiching the power feeding terminal 4 and the wiring board 8 as in the embodiment, when the antenna element 6 emits electromagnetic waves, induced current generated in the wiring board 8 is suppressed, and the radiation efficiency of the antenna device can be increased.

(Sixth Embodiment)

An antenna device of a sixth embodiment has: a finite ground plane; a rectangular conductor plate provided above the finite ground plane, whose one side is connected to the finite ground plane, and having a bent part almost parallel with the one side; an antenna disposed almost parallel with the finite ground plane above the finite ground plane, extending in a direction almost perpendicular to the one side, and having a feeding point positioned near the other side facing the one side of the rectangular conductor plate; and a magnetic material provided in at least a part of space between the finite ground plane and the antenna. The magnetic material is the core-shell magnetic material described in the first embodiment. Therefore, content overlapping that of the first embodiment will not be described.

The expression "above" shows a positional relation using, as a reference, the case where the finite ground plane is positioned below, and is not limited to an expression "above" in the vertical direction. The above is a concept including the case where two elements are in contact with each other.

Figure 2A:
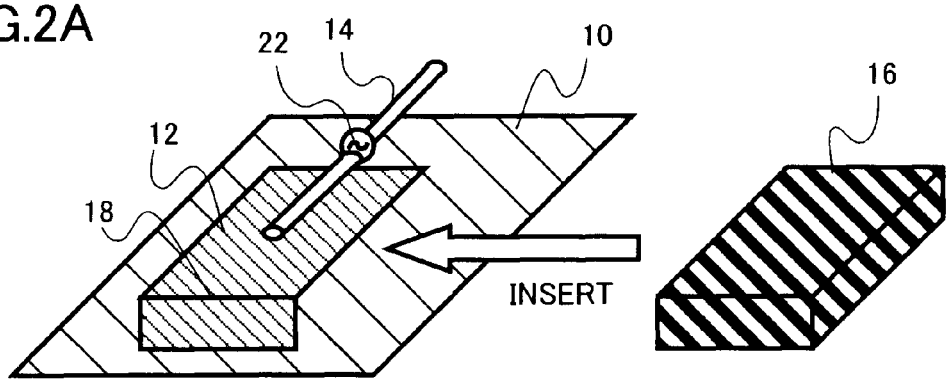
FIGS. 2A to 2C are configuration diagrams of an antenna device of a sixth embodiment.
Figure 2B:
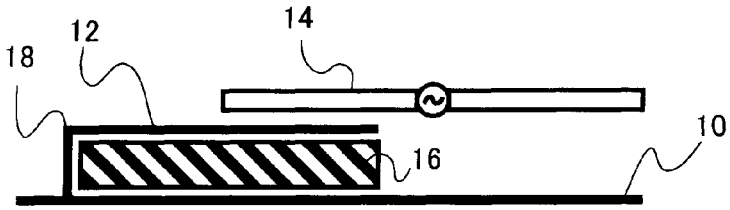
Figure 2C:
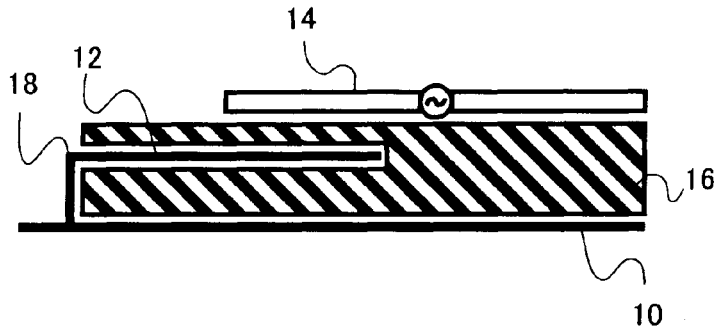

FIGS. 2A to 2C are configuration diagrams of the antenna device of the embodiment. FIG. 2A is a perspective view, FIG. 2B is a cross section, and FIG. 2C is a cross section of a modification.

The antenna device has a finite ground plane 10, a rectangular conductor plate 12 provided above the finite ground plane 10, an antenna 14 disposed in almost parallel with the finite ground plane 10 above the finite ground plane 10, and a magnetic material 16 provided in at least a part of space between the finite ground plane 10 and the antenna 14. In FIGS. 2A to 2C, the magnetic material 16is inserted between the finite ground plane 10 and the rectangular conductor plate 12. In FIG. 2A, the magnetic material 16 is shown separately from the antenna device so that the configuration of the antenna device is easily seen.

FIG. 2B shows that spaces are provided between the magnetic material 16 and the finite ground plane 10 and between the magnetic material 16 and the rectangular conductor plate 12. However, to increase the effect of insertion of the magnetic material 16, it is more preferable to eliminate the spaces and make the magnetic material 16 in contact with the finite ground plane 10 and the rectangular conductor plate 12. Further, in FIG. 2B, the magnetic material 16 is inserted only between the rectangular conductor plate 12 and the finite ground plane 10. The magnetic material 16 may be inserted so as to extent from the rectangular conductor plate 12 to a part of the antenna 14, or inserted also between the antenna 14 and the rectangular conductor plate 12 as shown in a modification of FIG. 2C.

From the viewpoint of adhesion between the magnetic material 16 and the finite ground plane 10, the rectangular conductor plate 12, and the antenna 14, it may be necessary to interpose another material in each of the spaces. In such a case, more preferably, in the space between the finite ground plane 10 and the antenna 14, the space other than the space occupied by the magnetic material is occupied by a dielectric material, and a combination of a dielectric material and a magnetic material having the same refractive index is chosen.

In the case of using only the magnetic material or a combination of a magnetic material and a dielectric material having different refractive indexes, reflection of electric waves occurs in the interface between the magnetic material and air or in the interface between the magnetic material and the dielectric material. When there is a loss in the magnetic material or the dielectric material, the radiation efficiency of the antenna device may deteriorate. Also when there is no loss, the reflection causes narrowing of the band. By making the refractive index in the space constant, unnecessary electric wave reflection can be suppressed, the deterioration in the radiation efficiency can be suppressed.

The finite ground plane 10 and the rectangular conductor plate 12 are made of a conductive material. One side of the rectangular conductor plate 12 is connected to the finite ground plane 10 and is electrically short-circuited. The rectangular conductor plate 12 has a bent portion 18 almost parallel with the one side. The antenna 14 is provided above the rectangular conductor plate 12, and extends in a direction almost perpendicular to the one side of the rectangular conductor plate 12 connected to the finite ground plane 10. A feeding point 22 of the antenna 14 is positioned near the other side opposite to the one side of the rectangular conductor plate 12. In FIGS. 2A to 2C, the antenna 14 is a dipole antenna.

The bent portion 18 of the rectangular conductor plate 12 can be formed by bending a rectangular conductor plate. Alternatively, in place of bending, two rectangular conductor plates which are electrically equivalent may be prepared and physically and electrically connected by a method such as soldering. In the antenna device of FIGS. 2A to 2C, the bent portion 18 of the rectangular conductor plate 12 has a right angle and is constructed by a part parallel to the finite ground plane 10 and a part perpendicular to the finite ground plane 10. The structure, however, is not essential. As long as electromagnetic wave propagation under the rectangular conductor plate 12 is obtained, it is not always necessary to provide the structure. That is, it is not always necessary to bend the rectangular conductor plate 12 at the right angle or provide a part parallel or perpendicular to the finite ground plane 10.

The sentence "the feeding point 22 of the antenna 14 is positioned near the other side opposite to the one side of the rectangular conductor plate 12" means that the position of the feeding point 22 is in the range of ⅙ electromagnetic wavelength or less of the operation frequency of the antenna 14 from the other side. As will be described later, the reason is that the adjustment position of the feeding point 22 for antenna matching lies in the range.

FIGS. 2A to 2C show the case where the antenna 14 is a dipole antenna. The dipole antenna in FIGS. 2A to 2C is obtained by linearly arranging two linear conductors and feeding power to the center of the conductors.

Figure 3:
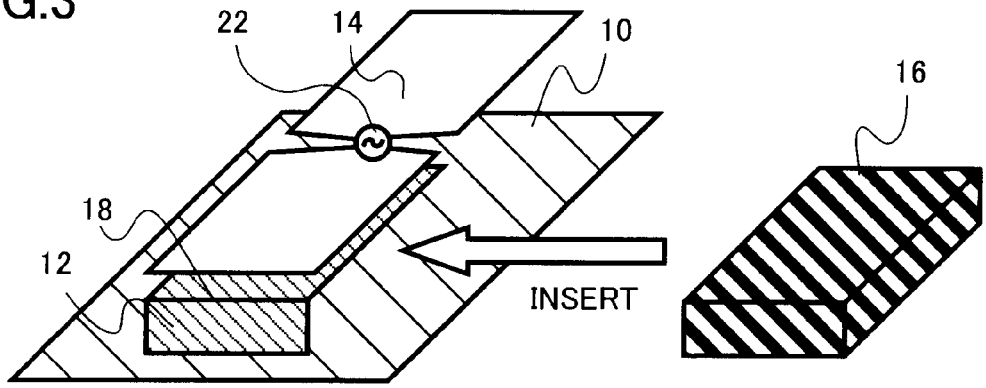
FIG. 3 is a configuration diagram of a first modification of the antenna device of the sixth embodiment.

FIG. 3 is a configuration diagram of a first modification of the antenna device of the embodiment. In the modification, as the antenna 14, a plate dipole antenna is applied. The plate dipole antenna is one of varieties of the dipole antenna, in which power is fed to the center of two conductors arranged, and sides close to the feeding point 22, of the conductors are obliquely cut so that the interval between the two conductor plates widens with distance from the feeding point 22. The plate dipole antenna has an advantage that a band wider than that of a dipole antenna using linear conductors can be realized.

Figure 4A:
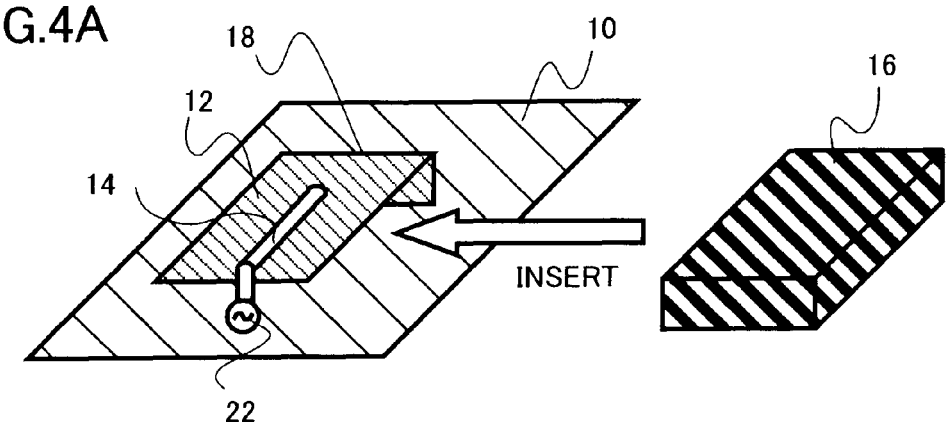
FIGS. 4A to 4C are configuration diagrams of a second modification of the antenna device of the sixth embodiment.
Figure 4B:
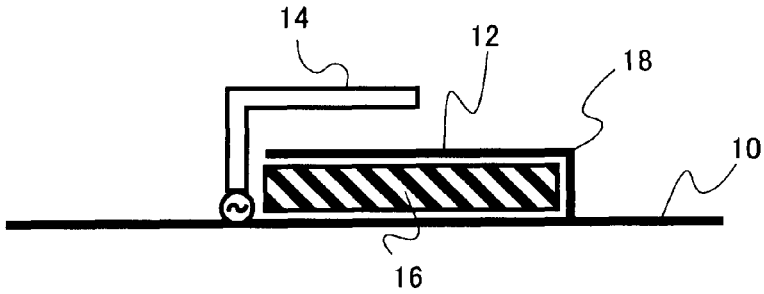
Figure 4C:
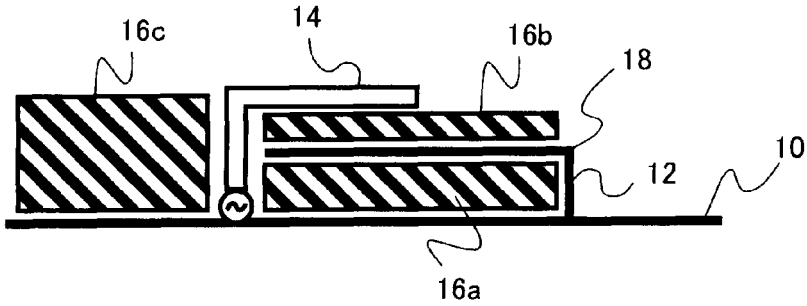

FIGS. 4A to 4C are configuration diagrams of a second modification of the antenna device of the embodiment. FIG. 4A is a perspective view, FIG. 4B is a cross section, and FIG. 4C shows another modification of the second modification. In the modification, a monopole antenna is used as the antenna 14. Different from the dipole antenna of FIGS. 2A to 2C, the monopole antenna does not have a linear conductor on the side far from the rectangular conductor plate 12 and is obtained by bending the feeding point 22 side so that the feeding point 22 is positioned on the finite ground plane 10. To realize further miniaturization of the antenna device, the monopole antennal is more preferable than the dipole antenna.

As shown in FIGS. 2A, 2B, 3, 4A, and 4B, the magnetic material 16 is inserted in at least a part of the space between the antenna 14 and the rectangular conductor plate 12, for example, between the rectangular conductor plate 12 and the limited bottom plate 10.

With the configuration, the antenna device of the embodiment can obtain impedance matching even in the case of realizing miniaturization including lower profile, and can obtain broadband property.

(Seventh Embodiment)

An antenna device of a seventh embodiment is a portable device which has: a wiring board; a spiral antenna element connected to a power feeding terminal provided for the wiring board; and a magnetic material provided on the inside of the spiral antenna element. The magnetic material is the core-shell magnetic material of the first embodiment. Therefore, content overlapping that of the first embodiment will not be described.

Figure 5:
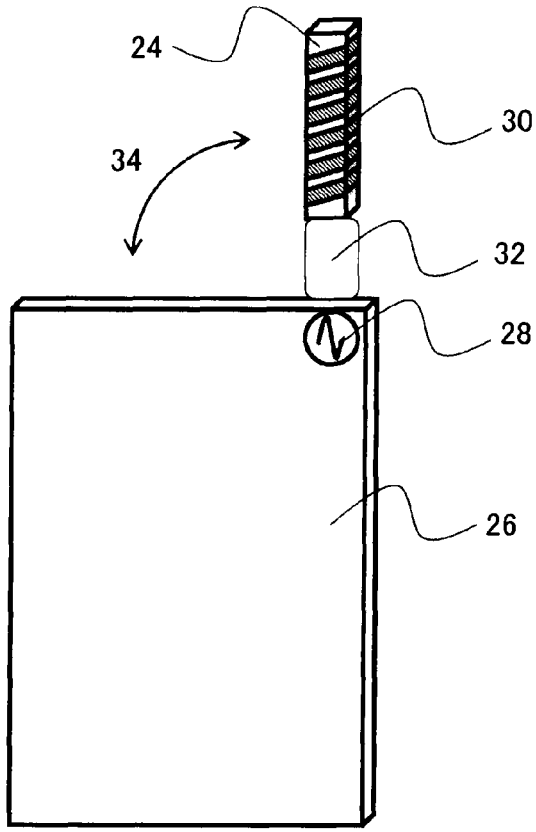
FIG. 5 is a configuration diagram of an antenna device of a seventh embodiment.

FIG. 5 is a configuration diagram of the antenna device of the seventh embodiment. A core-shell magnetic material 24 is provided on the inside of a spiral antenna element 30 connected to a wiring board 26 via a power feeding terminal 28 provided in the wiring board and an antenna movable part 32. The wiring board 26 is, for example, a wiring board on which a not-shown wireless circuit of a portable device is mounted and is surrounded by a package made of a nonconductive resin such as ABS, PC (polycarbonate) or the like. Further, the antenna movable part 32 may be of a 90-degree movable type as shown by movable directions 34, a pullout type, a 360-degree movable type, or the like.

Figure 6:
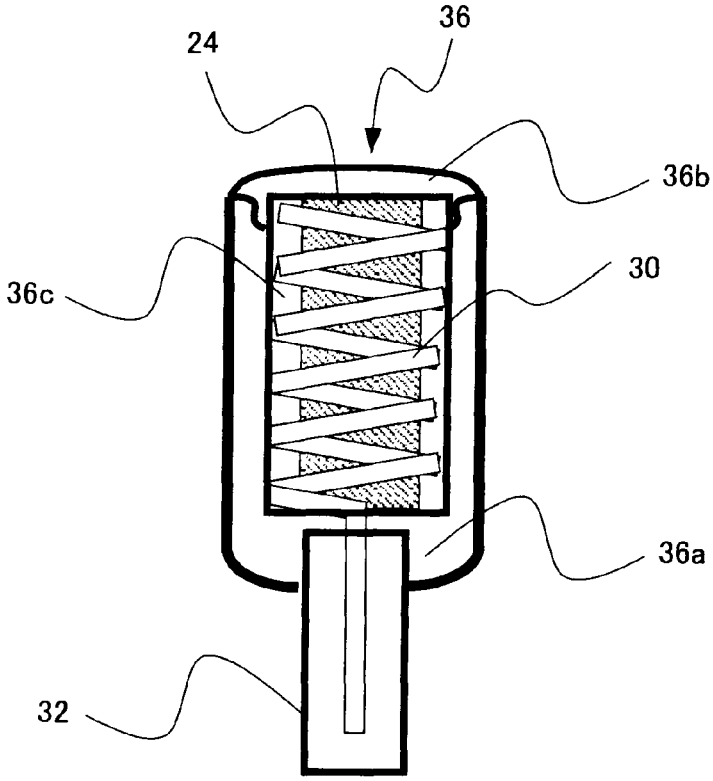
FIG. 6 is a detailed explanatory diagram of the antenna device of the seventh embodiment.

FIG. 6 is a detailed explanatory diagram of the antenna device of the seventh embodiment. An antenna cover 36 is made of a nonconductive resin and is constructed by a box part 36*a* and a lid part 36*b*. In the box part 36*a*, the antenna movable part 32 is inserted. On the inside, the spiral antenna element 30 is provided. The antenna movable part 32 and the spiral antenna element 30 are electrically connected to each other. The lid part 36*b* is connected to the box part 36*a* by adhesion or an adhesive in this state, thereby forming the antenna cover 36. The core-shell magnetic material 24 is provided in a cavity 36*c* in the spiral element 30.

The operation principle of the embodiment will be described. Since the antenna element 30 is constructed in a spiral shape, long antenna length can be realized in a small area, and an inductance component increases, so that the antenna element 30 is influenced by magnetic permeability more than permittivity. Therefore, by providing the core-shell magnetic material 24 on the inside of the spiral antenna element 30, even when the permittivity is high, particularly, a loss component is large to a certain degree, the influence is small, and the influence of magnetic permeability is large. Consequently, with a material having a small magnetic loss component, that is, a small imaginary part of complex relative magnetic permeability, decrease in the radiation efficiency is reduced, and an effect of miniaturization by the real part of the complex relative magnetic permeability can be expected.

By disposing the core-shell magnetic material 24 on the inside of the spiral antenna element 30 like in the seventh embodiment, the antenna element 30 can be miniaturized. As compared with the case of using a lumped-constant circuit, concentrative loss occurring in the circuit part can be lessened, so that the radiation efficiency of the antenna device can be increased.

The embodiments of the present invention have been described above with reference to concrete examples. The embodiments are described as examples and do not limit the present invention. In the description of the embodiments, parts which are not directly necessary for the description of the present invention in the core-shell magnetic material, the method of manufacturing the core-shell magnetic material, the device, the antenna device and the like are not described. However, necessary elements related to the core-shell magnetic material, the method of manufacturing the core-shell magnetic material, the device, the antenna device or the like may be properly selected and used.

All of core-shell magnetic materials, methods of manufacturing a core-shell magnetic material, devices, and antenna devices having the elements of the present invention and whose designs can be properly changed by a person skilled in the art are included in the scope of the present invention. The scope of the present invention is defined by the scope of claims and the scope of equivalents of the claims.

EXAMPLES

Examples of the present invention will be described more specifically below with reference to a comparative example. Average particle diameters of magnetic metal particles and oxide particles in the following examples and comparative example are measured on the basis of TEM observation. Concretely, an average of a longest diagonal line and a shortest diagonal line of each of particles captured in a TEM observation (picture) is used as a particle diameter of the particle. An average particle diameter is obtained from the average of the particle diameters. Three or more ranges each having a unit area of 10 μm×10 μm are taken from a picture, and an average value is obtained. Thickness of the oxide coating layer is obtained by TEM observation. Concretely, three or more ranges each having a unit area of 10 μm×10 μm are taken from a picture captured by TEM observation, oxide coating layers of particles included in the ranges are obtained, and an average value is obtained. By counting the number of core-shell magnetic particles and the oxide particles existing in the ranges, the quantitative ratio of the numbers of particles is calculated.

The composition analysis of a microstructure is performed on the basis of an EDX analysis. By the analysis, the relation of nonmagnetic metal/magnetic metal (atomic ratio) in the oxide particle and nonmagnetic metal/magnetic metal (atomic ratio) in the oxide coating layer is obtained.

Example 1

Argon as plasma generation gas is introduced at 40 L/min into a chamber in a high-frequency induction thermal plasma apparatus to generate plasma. FeCoAl solid solution powders having an average particle diameter of 10 μm and having an Fe:Co:Al atomic ratio of 70:30:5 (amount of Al is 5 atomic % when FeCo is 100) and Al powders having an average particle diameter of 3 μm as the material are injected together with argon (carrier gas) at 3 L/min so as to become 5 atomic % of FeCo 100 in the solid solution powders to the plasma in the chamber (that is, total Al amount to FeCo is 10 atomic %; 5 atomic % from the FeCoAl solid solution powders, and 5 atomic % from the Al powders). In such a manner, magnetic metal particles and nonmagnetic metal particles are manufactured.

Simultaneously, acetylene gas as a carbon coating material is introduced together with the carrier gas into the chamber, thereby obtaining the magnetic metal particles coated with carbon. The carbon coated magnetic metal particles are subjected to reduction treatment at 600° C. under hydrogen flow of 500 mL/min and concentration of 99%, and cooled to room temperature. After that, the particles are taken in an oxygen containing atmosphere, and oxidized. In such a manner, the core-shell magnetic materials are manufactured. At this time, the nonmagnetic metal particles are also oxidized, and oxide particles are formed.

The obtained core-shell magnetic material includes the core-shell magnetic metal particles and the oxide particles. The average particle diameter of the magnetic metal particles included in the core-shell magnetic metal particles is 17±4 nm, and thickness of the oxide coating layer is 1.9±0.3 nm. The magnetic metal particle in the core is constructed by Fe—Co—Al—C, and the oxide coating layer is constructed by Fe—Co—Al—O.

In XRD measurement of the magnetic metal particles, only a peak of FeCo is detected, and the lattice constant of FeCo is about 2.87. It is consequently understood that by employing the core-shell structure with a small particle diameter in a state where Al and C contained in the magnetic metal particles are solved in FeCo in a solid solution state, the lattice of FeCo is slightly distorted. The solid solution state mixture is also confirmed from a particle diffraction pattern by TEM and a high-resolution TEM picture.

Figure 7:
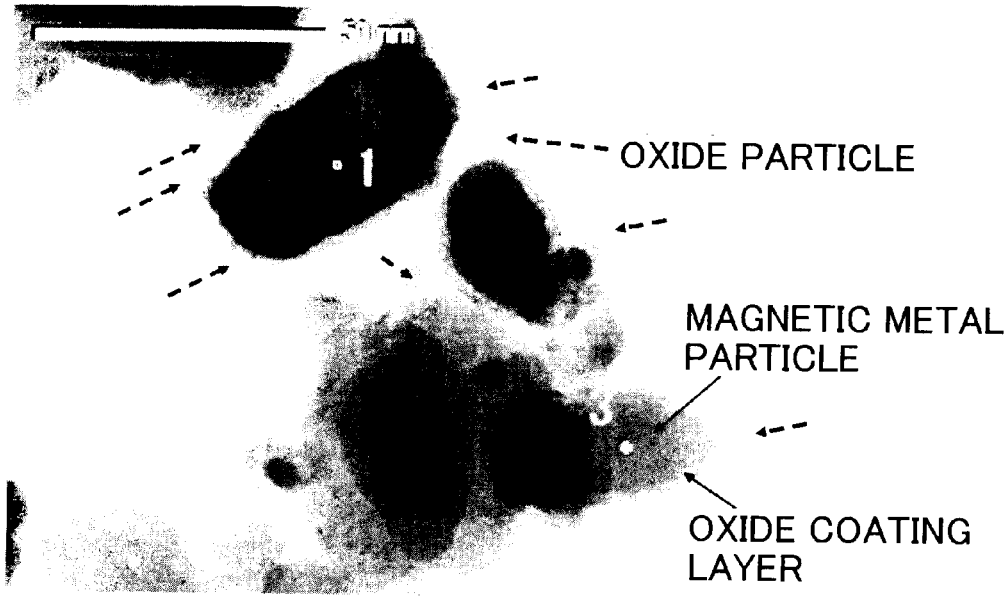
FIG. 7 is a sectional TEM photograph of a core-shell magnetic material of example 1.

Both thickness and composition of the oxide coating layer are not so varied and are uniform. Between the magnetic metal particles, a number of oxide particles constructed by Al—O (partially FeCo solid solution state mixture) and having an average particle diameter of about 10±3 nm exist. The particle diameters and compositions of the oxide particles are not so varied and are uniform. Al/(Fe+Co) in the oxide particles is larger than that in the oxide coating layer. The number of oxide particles is about 50% of the number of the core-shell magnetic particles. FIG. 7 shows a sectional TEM picture of the core-shell magnetic material obtained by the example 1. Parts indicated by dotted-line arrows are oxide particles.

Such core-shell magnetic material and a resin are mixed at a ratio of 100:10, the film thickness is increased, and the resultant is used as a material for evaluation.

Example 2

Argon as plasma generation gas is introduced at 40 L/min into a chamber in a high-frequency induction thermal plasma apparatus to generate plasma. Fe powders having an average particle diameter of 10 μm, Co particles having an average particle diameter of 10 μm, and Al powders having an average particle diameter of 3 μm as the material are injected together with argon (carrier gas) at 3 L/min to the plasma in the chamber so that Fe:Co:Al becomes 70:30:10 in atomic ratio. Simultaneously, acetylene gas as a carbon coating material is introduced together with the carrier gas into the chamber, thereby obtaining magnetic metal particles obtained by coating the FeCoAl alloy particles with carbon.

The carbon-coated FeCoAl nano-particles are subjected to reduction treatment at 600° C. under hydrogen flow of 500 mL/min and concentration of 99%, and cooled to room temperature. After that, the particles are taken in an oxygen containing atmosphere, and oxidized. In such a manner, the core-shell magnetic materials are manufactured.

The core-shell magnetic materials in the obtained core-shell magnetic material have a structure that an average particle diameter of the magnetic metal particles in the core is 18±7 nm, and thickness of the oxide coating layer is 2.5±0.5 nm. The magnetic metal particle in the core is constructed by Fe—Co—Al—C, and the oxide coating layer is constructed by Fe—Co—Al—O. Al/(Fe+Co) in the oxide particles is larger than that in the oxide coating layer. The number of oxide particles is about 60% of the number of the core-shell magnetic particles.

Between the magnetic metal particles in the core-shell magnetic material, a number of oxide particles constructed by Al—O (partially FeCo solid solution state mixture) and having an average particle diameter of about 13±5 nm exist. The diameter and composition of the magnetic metal particle in the core, thickness and composition of the oxide coating layer, and the diameter and composition of the oxide particle are various slightly more than those of the example 1.

Such core-shell magnetic material and a resin are mixed at a ratio of 100:10, the film thickness is increased, and the resultant is used as a material for evaluation.

Example 3

Argon as plasma generation gas is introduced at 40 L/min into a chamber in a high-frequency induction thermal plasma apparatus to generate plasma. FeCoSi solid solution powders having an average particle diameter of 10 μm and having an Fe:Co:Si atomic ratio of 70:30:2.5 (amount of Si is 2.5 atomic % when FeCo is 100) and Si powders having an average particle diameter of 5 μm as the material are injected together with argon (carrier gas) at 3 L/min so as to become 2.5 atomic % of FeCo 100 in the solid solution powders to the plasma in the chamber (that is, total Si amount to FeCo is 5 atomic %; 2.5 atomic % from the FeCoSi solid solution powders, and 2.5 atomic % from the Si powders). In such a manner, magnetic metal particles and nonmagnetic metal particles are manufactured.

At the same time with the injection, acetylene gas as a carbon coating material is introduced together with the carrier gas into the chamber, thereby obtaining the magnetic metal particles coated with carbon. The carbon coated magnetic metal particles are subjected to reduction treatment at 600° C. under hydrogen flow of 500 mL/min and concentration of 99%, and cooled to room temperature. After that, the particles are taken in an oxygen containing atmosphere, and oxidized. In such a manner, the core-shell magnetic materials are manufactured. At this time, the nonmagnetic metal particles are also oxidized, and oxide particles are formed.

The obtained core-shell magnetic material includes the core-shell magnetic metal particles and the oxide particles. The average particle diameter of the magnetic metal particles included in the core-shell magnetic metal particles is 19±4 nm, and thickness of the oxide coating layer is 2.0±0.3 nm. The magnetic metal particle in the core is constructed by Fe—Co—Si—C, and the oxide coating layer is constructed by Fe—Co—Si—O.

In XRD measurement of the magnetic metal particles, only a peak of FeCo is detected, and the lattice constant of FeCo is about 2.864. It is consequently understood that by employing the core-shell structure with a small particle diameter in a state where Si and C contained in the magnetic metal particles are solved in FeCo in a solid solution state, the lattice of FeCo is slightly distorted. The solid solution state mixture is also confirmed from a particle diffraction pattern by TEM and a high-resolution TEM picture.

Both thickness and composition of the oxide coating layer are not so varied and are uniform. Between the magnetic metal particles, a number of oxide particles constructed by Si—O (partially FeCo solid solution state mixture) and having an average particle diameter of about 12±4 nm exist. The particle diameters and compositions of the oxide particles are not so varied and are uniform. Si/(Fe+Co) in the oxide particles is larger than that in the oxide coating layer. The number of oxide particles is about 50% of the number of the core-shell magnetic particles.

Such core-shell magnetic material and a resin are mixed at a ratio of 100:10, the film thickness is increased, and the resultant is used as a material for evaluation.

Example 4

Argon as plasma generation gas is introduced at 40 L/min into a chamber in a high-frequency induction thermal plasma apparatus to generate plasma. Fe powders having an average particle diameter of 10 μm, Co particles having an average particle diameter of 10 μm, and Si powders having an average particle diameter of 5 μm as the material are injected together with argon (carrier gas) at 3 L/min to the plasma in the chamber so that Fe:Co:Si becomes 70:30:5 in atomic ratio. Simultaneously, acetylene gas as a carbon coating material is introduced together with the carrier gas into the chamber, thereby obtaining magnetic metal particles obtained by coating the FeCoSi alloy particles with carbon.

The carbon-coated FeCoSi nano-particles are subjected to reduction treatment at 600° C. under hydrogen flow of 500 mL/min and concentration of 99%, and cooled to room temperature. After that, the particles are taken in an oxygen containing atmosphere, and oxidized. In such a manner, the core-shell magnetic materials are manufactured.

The core-shell magnetic particles in the obtained core-shell magnetic material have a structure that an average particle diameter of the magnetic metal particles in the core is 20±7 nm, and thickness of the oxide coating layer is 2.3±0.6 nm. The magnetic metal particle in the core is constructed by Fe—Co—Si—C, and the oxide coating layer is constructed by Fe—Co—Si—O.

In XRD measurement of the magnetic metal particles, only a peak of FeCo is detected, and the lattice constant of FeCo is about 2.864. It is consequently understood that by employing the core-shell structure with a small particle diameter in a state where Si and C contained in the magnetic metal particles are solved in FeCo in a solid solution state, the lattice of FeCo is slightly distorted. The solid solution state mixture is also confirmed from a particle diffraction pattern by TEM and a high-resolution TEM picture.

Between the magnetic metal particles in the core-shell magnetic material, a number of oxide particles constructed by Si—O (partially FeCo solid solution state mixture) and having an average particle diameter of about 14±6 nm exist. Variations in the magnetic metal particles in the core, the oxide coating layer, and the oxide particles are slightly larger as compared with the example 3 as described above. Si/(Fe+Co) in the oxide particles is larger than that in the oxide coating layer. The number of oxide particles is about 60% of the number of the core-shell magnetic particles.

Such core-shell magnetic material and a resin are mixed at a ratio of 100:10, the film thickness is increased, and the resultant is used as a material for evaluation.

Comparative Example 1

Argon as plasma generation gas was introduced at 40 L/min into a chamber in a high-frequency induction thermal plasma apparatus to generate plasma. FeCoAl powders having an average particle diameter of 10 μm and having an Fe:Co:Al atomic ratio of 70:30:10 as the material are injected together with argon (carrier gas) at 3 L/min to plasma in the chamber. Simultaneously, acetylene gas as a carbon coating material is introduced together with the carrier gas into the chamber, thereby obtaining FeCoAl alloy particles as nanoparticles coated with carbon. The carbon coated FeCoAl nanoparticles are subjected to reduction treatment at 600° C. under hydrogen flow of 500 mL/min and concentration of 99%, and cooled to room temperature. After that, the particles are taken in an oxygen containing atmosphere, and oxidized. In such a manner, the core-shell magnetic material having the core-shell magnetic particles is manufactured.

The obtained core-shell magnetic particle in the core-shell magnetic material has a structure that the average particle diameter of the magnetic metal particles of the core is 19 nm, and thickness of the oxide coating layer is 2.7 nm. The magnetic metal particle in the core is constructed by Fe—Co—Al—C, and the oxide coating layer is constructed by Fe—Co—Al—O.

In XRD measurement of the magnetic metal particles, only a peak of FeCo is detected, and the lattice constant of FeCo is about 2.87. It is consequently understood that by employing the core-shell structure with a small particle diameter in a state where Al and C contained in the magnetic metal particles are solved in FeCo in a solid solution state, the lattice of FeCo is slightly distorted. The solid solution state mixture is also confirmed from a particle diffraction pattern by TEM and a high-resolution TEM picture.

Both thickness and composition of the oxide coating layer are not so varied and are uniform. Between the magnetic metal particles, oxide particles hardly exist. That is, the number of oxide particles is 10% or less of the number of the core-shell magnetic particles. Such core-shell magnetic material and a resin are mixed at a ratio of 100:10, the film thickness is increased, and the resultant is used as a material for evaluation.

Table 1 shows outline of the magnetic metal particles, the oxide coating layers, and the oxide particles of the ore-shell magnetic materials used in the examples 1 to 4 and the comparative example 1. Changes with time and the electromagnetic wave absorption characteristic of a magnetic permeability real part (μ') and those of a magnetic permeability real part (μ') after 100 hours were exampled by the following method on the materials for evaluation of the examples 1 to 4 and the comparative example 1. FIG. 2 shows the resultant.

1) Magnetic Permeability Real Part μ'

An induced voltage value and an impedance value when air is the background and those when a sample is disposed at 1 GHz were measured by using the system PMM-9G1 manufactured by Ryowa Electronics Co., Ltd. From the induced voltage values and the impedance values, a magnetic permeability real part μ' was derived. A sample processed in dimensions of 4×4×0.5 mm was used.

2) Changes With Time in Magnetic Permeability Real Part μ' After 100 Hours

The samples for evaluation were left for 100 hours in a high-temperature high-humidity vessel having a temperature of 60° C. and a humidity of 90%. After that, the magnetic permeability real part μ' was measured, and a change with time (magnetic permeability real part μ' after 100 hours/magnetic permeability real part μ' before the leaving) was obtained.

3) Electromagnetic Wave Absorption Characteristic

To the surface opposite to an electromagnetic wave irradiation surface of a sample for evaluation, a metal thin plate having the thickness of 1 mm and the same area is adhered. By using an $S_{11}$ mode of a sample network analyzer with electromagnetic waves of 2 GHz, measurement was performed using a reflected power method in free space. The reflected power method is a method of measuring a decrease (in dB) of the reflection level from a sample as compared with the reflection level of a metal thin plate (complete reflector) to which a sample is not adhered. On the basis of the measurement, an electromagnetic wave absorption amount is defined by a reflection loss and obtained as a relative value when the absorption amount of the comparative example 1 is 1.

TABLE 1

| | Magnetic Metal Particle | | | | | Oxide Coating Layer | | Oxide Particle | |
|---|---|---|---|---|---|---|---|---|---|
| | Magnetic Metal | Non Magnetic Metal | C or N | Composition (Atomic Ratio) | Partticle Di-ameter (nm) | Composition | Thickness (nm) | Composition | Particle Di-ameter (nm) |
| Example 1 | FeCo | Al | C | Fe:Co:Al:C = 70:30:0.02:0.019 | 17 ± 4 | Fe—Co—Al—O | 1.9 ± 0.3 | Al—O (Slight FeCo is solved) | 10 ± 3 |
| Example 2 | FeCo | Al | C | Fe:Co:Al:C = 70:30:0.02:0.02 | 18 ± 7 | Fe—Co—Al—O | 2.5 ± 0.5 | Al—O (Slight FeCo is solved) | 13 ± 5 |
| Example 3 | FeCo | Si | C | Fe:Co:Si:C 70:30:0.015:0.018 | 19 ± 4 | Fe—Co—Si—O | 2.0 ± 0.3 | Si—O (Slight FeCo is solved) | 12 ± 4 |
| Example 4 | FeCo | Si | C | Fe:Co:Si:C = 70:30:0.015:0.019 | 20 ± 7 | Fe—Co—Si—O | 2.3 ± 0.6 | Si—O (Slight FeCo is solved) | 14 ± 6 |
| Comparative Example 1 | FeCo | Al | C | Fe:Co:Al:C = 70:30:0.019:0.019 | 19 ± 4 | Fe—Co—Al—O | 2.7 ± 0.4 | — | — |

TABLE 2

| | Characteristics of High-frequency Magnetic Material | | |
|---|---|---|---|
| | Magnetic Permeability Real part μ' (at 1 GHz) | Change with time in Magnetic Permeability Real part μ' after 100 hors (at 1 GHz) | Electromagnetic Absorption Characteristics (at 2 GHz) |
| Example 1 | 5.8 | 0.99 | 1.2 |
| Example 2 | 5.5 | 0.98 | 1.05 |
| Example 3 | 5.7 | 0.99 | 1.15 |
| Example 4 | 5.4 | 0.98 | 1.05 |
| Comparative Example 1 | 5.3 | 0.975 | 1.0 |

As obvious from Table 1, the core-shell magnetic material of Example 1 includes: the core-shell magnetic particles as magnetic metal particles containing FeCo as a magnetic metal, Al as a nonmagnetic metal, and carbon, having an average particle diameter of about 17 nm, and coated with an oxide coating layer containing Al as nonmagnetic metal as one of the components of the magnetic metal particle and having a thickness of 1.9 nm; and a number of oxide particles existing between the magnetic metal particles in the core-shell magnetic particles, containing Al as nonmagnetic metal, and having a particle diameter of about 10 nm.

It is also understood that the core-shell magnetic material of Example 3 includes: the core-shell magnetic particles as magnetic metal particles containing FeCo as a magnetic metal, Si as a nonmagnetic metal, and carbon, having an average particle diameter of about 19 nm, and coated with an oxide coating layer containing Si as nonmagnetic metal as one of the components of the magnetic metal particle and having a thickness of about 2.0 nm; and a number of oxide particles existing between the magnetic metal particles in the core-shell magnetic particles, containing Si as nonmagnetic metal, and having a particle diameter of about 12 nm.

The magnetic materials of Examples 2 and 4 are similar to Examples 1 and 3 with respect to the point that "the material is constructed by particles having the core-shell structure and the oxide particles existing between the magnetic metal particles", although variations in the magnetic metal particle as the core, the oxide coating layer, and the oxide particle are slightly larger than those of Examples 1 and 3, that is, uniformity is slightly lower.

Although the magnetic material of Comparative Example 1 has a uniform shell structure, oxide particles hardly exist between the core-shell magnetic particles and between the magnetic metal particles.

As obvious from Table 2, the core-shell magnetic materials of Examples 1 to 4, particularly, Examples 1 and 3 have more excellent magnetic characteristics as compared with that of the material of Comparative Example 1. It is considered that the core-shell magnetic materials of Examples 1 to 4 have moderate magnetic anisotropy and can realize high magnetic permeability at high frequencies by the facts that, in the core-shell magnetic particles in a resin, "carbon or nitrogen is solved in a solid solution state in the magnetic metal particles" and "a number of uniform nonmagnetic oxide particles exist between the magnetic metal particles and between the core-shell magnetic metal particles". It is considered that the materials of Examples 1 and 3 realize more excellent characteristics by "having a more uniform core-shell structure". Although the magnetic permeability real part (μ') shows a flat frequency characteristic only at 1 GHz, almost the same value is displayed also at 100 MHz.

It is also understood that the core-shell magnetic materials of Examples 1 to 4, particularly, the core-shell magnetic materials of Examples 1 and 3 have small changes with time in the magnetic permeability real part (μ') after 100 hours and have extremely high thermal stability. The magnetic metal particle is coated with the oxide coating layer containing a nonmagnetic metal as one of the components and has the uniform core-shell structure. In addition, by existence of a number of uniform nonmagnetic oxide particles between the magnetic metal particles and between the core-shell magnetic metal particles, the magnetic metal particles become stabler, and high thermal stability can be realized.

In contrast, the material of Comparative Example 1 is insufficient as compared with the materials of Examples 1 to 4 with respect to "existence of a number of uniform nonmagnetic oxide particles between the magnetic metal particles and the core-shell magnetic metal particles". Accordingly, the magnetic characteristic or thermal stability is slightly lower than that of Examples 1 to 4.

In the core-shell magnetic materials of Examples 1 to 4, the magnetic permeability real part (μ') at 1 GHz is high. It is understood that the materials have the possibility that they are used as high-magnetic-permeability parts (using high μ' and low μ") such as an inductor, a filter, a transformer, a choke coil, an antenna boards for a cellular phone, a wireless LAN, and the like in the 1 GHz band.

Further, the core-shell magnetic materials of Examples 1 to 4 have excellent thermal stability. The core-shell magnetic materials of Examples 1 to 4, particularly, the core-shell magnetic materials of Examples 1 and 3 have the excellent electromagnetic wave absorption characteristic at 2 GHz, so that they can be used as electromagnetic wave absorbers (using high μ") in the 2 GHz band. That is, by changing a use frequency band, a single material can be used as the high-magnetic-permeability part and also as the electromagnetic wave absorber. The material has broad utility.

What is claimed is:

1. A portable device comprising:

a wiring board;

a spiral antennal element connected to a power feeding terminal provided for the wiring board; and a magnetic material provided on the inside of the antenna element, wherein the magnetic material is a core-shell magnetic material containing core-shell magnetic particles including:

magnetic metal particles containing:

at least one magnetic metal selected from the group of Fe, Co, and Ni, at least one nonmagnetic metal selected from the group of Mg, Al, Si, Ca, Zr, Ti, Hf, Zn, Mn, a rare-earth element, Ba, and Sr, at least one element selected from carbon and nitrogen, and an oxide coating layer coating surfaces of at least a part of the magnetic metal particles, the oxide coating layer being made of an oxide containing at least one nonmagnetic metal contained in the magnetic metal particles; and oxide particles existing in at least a part of space between the magnetic metal particles, the oxide particles containing at least one nonmagnetic metal selected from the group of Mg, Al, Si, Ca, Zr, Ti, Hf, Zn, Mn, a rare-earth element, Ba, and Sr, wherein a nonmagnetic metal/magnetic metal ratio in the oxide particles is higher than that in the oxide coating layer, the nonmagnetic metal/magnetic metal ratio being an atomic ratio;

wherein the nonmagnetic metal/magnetic metal ratio is the atomic ratio.

2. The portable device according to claim 1, wherein the magnetic metal particles have an average particle diameter of 1 nm to 1,000 nm, the oxide coating layer has a thickness of 0.1 nm to 100 nm, and the oxide particles have an average particle diameter of 1 nm to 100 nm.

3. The portable device according to claim 1, wherein the magnetic metal particle contains 0.001 atomic % to 20 atomic % of the nonmagnetic metal with respect to the magnetic metal, the magnetic metal particle contains 0.001 atomic % to 20 atomic % of at least one element selected from carbon and nitrogen with respect to the magnetic metal, and at least two components out of the magnetic metal in the magnetic metal particle, the non-magnetic metal in the magnetic metal particle, and the element are in a solid solution state.

4. The portable device according to claim 1, wherein the magnetic metal particle contains FeCo, at least one element selected from Al and Si, and carbon, FeCo contains 10 atomic % to 50 atomic % of Co, 0.001 atomic % to 5 atomic % of at least one element selected from Al and Si with respect to FeCo is contained, and 0.001 atomic % to 5 atomic % of carbon with respect to FeCo is contained.

5. The portable device according to claim 1, wherein the magnetic metal particle has an aspect ratio of 10 or higher.

6. The portable device according to claim 1, further comprising an antenna movable part provided between the wiring board and the spiral antennal element, the antenna movable part configured to move the spiral antennal element.

7. The portable device according to claim 6, wherein, the antenna movable part is a 90-degree movable type, a pullout type, or a 360-degree movable type.

8. The portable device according to claim 1, further comprising a package made of a nonconductive resin surrounding the wiring board.

9. The portable device according to claim 1, further comprising an antenna cover made of a nonconductive resin configured to cover the spiral antennal element.

10. The portable device according to claim 1, wherein, core-shell magnetic particles are provided in a cavity in the spiral antennal element.

* * * * *